US005771715A

United States Patent [19]

Soukenik et al.

[11] Patent Number: 5,771,715

[45] Date of Patent: Jun. 30, 1998

[54] CONVERTIBLE EAR ORNAMENT

[76] Inventors: Joseph Soukenik, 5296 ColdBrook Dr., Mantua, Ohio 44235; Thomas Quirk, 726 Village Club Dr., Sagamore Hills, Ohio 44067; Christopher Mielczarek, 493 Peacock La., Rockcreek, Ohio 44084

[21] Appl. No.: 837,087

[22] Filed: Apr. 14, 1997

Related U.S. Application Data

[63] Continuation of Ser. No. 601,090, Feb. 14, 1996, abandoned.

[51] Int. Cl.[6] ..... A44C 7/00

[52] U.S. Cl. ..... 63/14.1; 63/14.6; 63/14.7

[58] Field of Search ..... 63/14.1, 14.2, 63/14.3, 14.6, 14.7, 14.8, 1.11, 1.18, 12

[56] References Cited

U.S. PATENT DOCUMENTS

| | | | |
|---|---|---|---|
| 5,048,310 | 9/1991 | Riley | 63/13 |
| 5,048,311 | 9/1991 | Mastrobuono | 63/12 |
| 5,184,482 | 2/1993 | Cloud | 63/14.1 |
| 5,438,850 | 8/1995 | Keating et al. | 63/2 |
| 5,537,842 | 7/1996 | Battista | 63/14.7 X |

*Primary Examiner*—Kient T. Nguyen
*Attorney, Agent, or Firm*—Albert E. Chrow

[57] ABSTRACT

A convertible ear ornament is provided that in one embodiment referenced by numeral (100) features an ornamental member (14) having an accessible pocket (16) into which a variety of bracket members (22, 23, 25, 27, 60) may be releasably secured to provide different attachment means enabling one to provide a singular ornamental member (14) with a variety of means of attaching member (14) to an ear portion including a pierced ear opening post (26), a pivotable clip (32), a rotating clamp (42), and an ear loop (46) and which in another embodiment features an ornamental member (50) having a pair of spaced-apart overhanging members (52) and (54) defining an open-sided pocket into which the bracket member may be releasably secured.

6 Claims, 3 Drawing Sheets

CONVERTIBLE EAR ORNAMENT

CROSS REFERENCE TO RELATED APPLICATION

This application is a Continuation of application Ser. No. 08/601,090, Filed On Feb. 14, 1996, now abandoned.

INTRODUCTION

This invention relates generally to a decorative ear ornament and more particularly to a decorative ear ornament that can be easily converted for attachment to a person's ear by a variety of devices.

BACKGROUND OF THE INVENTION

In most instances, ear ornaments have heretofore been limited for attachment to a person's ear in a singular manner generally limited to either a post for insertion through a pierced ear opening or a spring clamp for clipping to an ear or by rotation of a threaded member operative to clamp the ear ornament to an ear.

As such, prior art ear ornaments have for the most part been limited in their method of attachment to a person's ear making the development of a universal ear ornament adapted for attachment to a person's ear in a variety of ways extremely attractive.

There are numerous reasons supporting the uses for a universal ear ornament. For example, a survey in the Fall, 1994 edition of "National Jeweler" indicates that 10% of the national market do not have pierced ears or, if they do, may desire that their ear ornaments be attachable by other ways due to infected pierced ear openings that may arise from exposure to hair spray, perfume, medications, change in diet, or pregnancy, etc.

In some instances a person may have a pierced opening through only one ear and is thus unable to utilize a pair of matched ear rings that are both provided with post attachments for pierced ear openings whereas, had the ear ring been universally attachable, they might have replaced one of the posts with a clamp or clip-on type attachment.

Although most ear ornaments feature either post, screw or clip-on attachments, an example of a variety of ear ornaments attached to the ear by looped members that encircle the entire ear is disclosed in U.S. Pat. No. 5,184,482, the disclosure of which is incorporated herein by reference.

Two examples of convertible type ear rings are disclosed in U.S. Pat. Nos. 5,048,310 and 5,048,311, the disclosures of which are incorporated herein by reference. Both however feature conversion mechanisms that are entirely different from the convertible ear ornament of the present invention. Where, for example, in U.S. Pat. No. 5,048,310, the screw clamping mechanism is fixedly secured to a decorative portion of the ear ring and in U.S. Pat. No. 5,048,311 the holding bracket is soldered or welded onto a decorative portion of the ear ring and neither of which are relied upon for the convertible ear ornament of the present invention.

In contrast to the above, the convertible ear ornament of the present invention provides a variety of ear attachment members that are entirely separated from the decorative or ornamental portion of the ear ornament and which can easily be changed from one and another by a single hand squeezing motion on the pair of spaced-upon resilient arms associated with a bracket member used in combination with an ornamental member to provide the convertible ear ornament of the present invention.

SUMMARY OF THE INVENTION

Accordingly, it is an object of this invention to provide a convertible ear ornament.

It is another object of this invention to provide an ear ornament for which the mechanism for attaching the ornament to a person's ear can be quickly and easily converted.

DESCRIPTION OF SOME PREFERRED EMBODIMENTS

Figure 1:
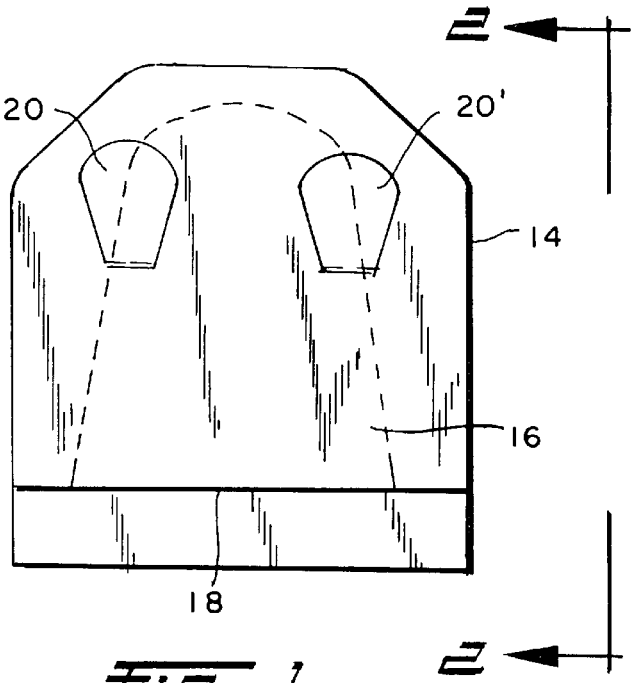
FIG. 1 is a back elevation view of an embodiment of an ornamental member 14 of the convertible ear ornament of the invention shown in FIGS. 11 and 12.
Figure 2:
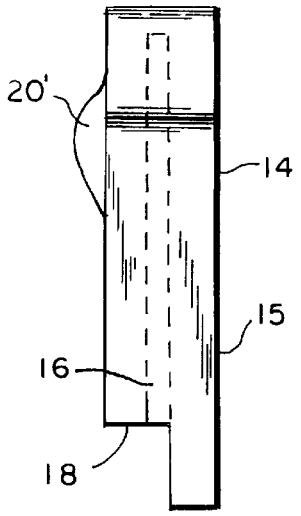
FIG. 2 is a side view of ornamental member 14 taken along view line 2—2 in FIG. 1.

Although ornamental member 14 of FIG. 1 is shown as having a generally rectangular configuration in FIG. 1 (except for the cut-off corners at the upper end), it may have any configuration provided it also includes an accessible pocket 16 having an entryway of which an example is referenced by numeral 18 in FIGS. 1 and 2.

The back side of ornamental member 14 shown in FIG. 1 preferably includes at least one and more preferably two spaced-apart arcuate surfaces 20 and 20' that curve convexly outwardly to provide pads for engaging an ear portion such as the ear lobe.

The front side of ornamental member 14 shown in FIG. 2 and referenced by numeral 15 may be ornamented in numerous ways including being polished and/or engraved or utilized to adhere additional decorative elements such as gem stones and the like.

Surface 15 may also include posts and/or recesses (not shown) for securing additional decorative members to it to even further enlarge the versatility of the convertible ear ornament of the invention.

Although ornamental member 14 may be made of any suitable ornamental material conducive for use in connection with a person's ear ornament, it is preferably cast from gold such as 14 karat gold or a hypoallergenic stainless steel.

Bracket members 22–27 shown in FIGS. 2–10 are embodiments of bracket members that can be used in combination with ornamental member 14 to provide the convertible ear ornament of the invention.

Figure 3:
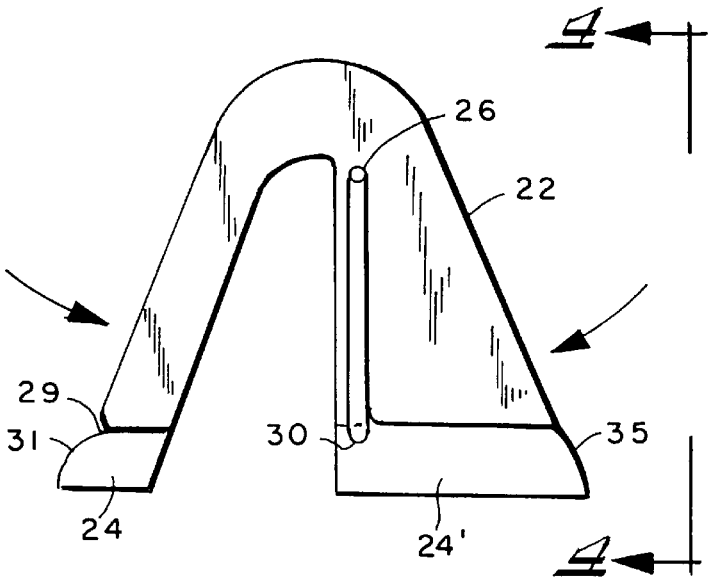
FIG. 3 is a front elevation view of a bracket member 22 used in connection with ornamental member 14 of FIGS. 1 and 2.
Figure 4:
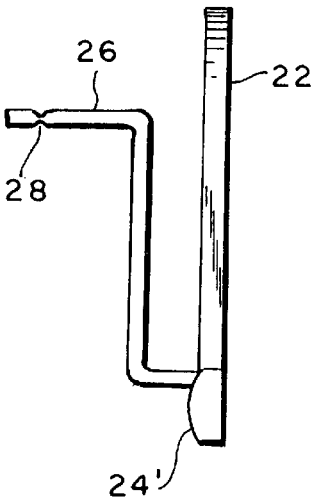
FIG. 4 is a side elevation view of an embodiment of bracket member 22 taken along view line 4—4 in FIG. 3.

Bracket member 22 of FIGS. 3 and 4 is configured to be received into pocket 16 or ornamental member 14 of FIG. 1 and combined in working engagement therewith.

Although other configurations may be utilized, both pocket 16 and bracket member 22 preferably have the generally triangular configuration with the rounded apex's shown in FIGS. 1 and 3.

Figure 11:
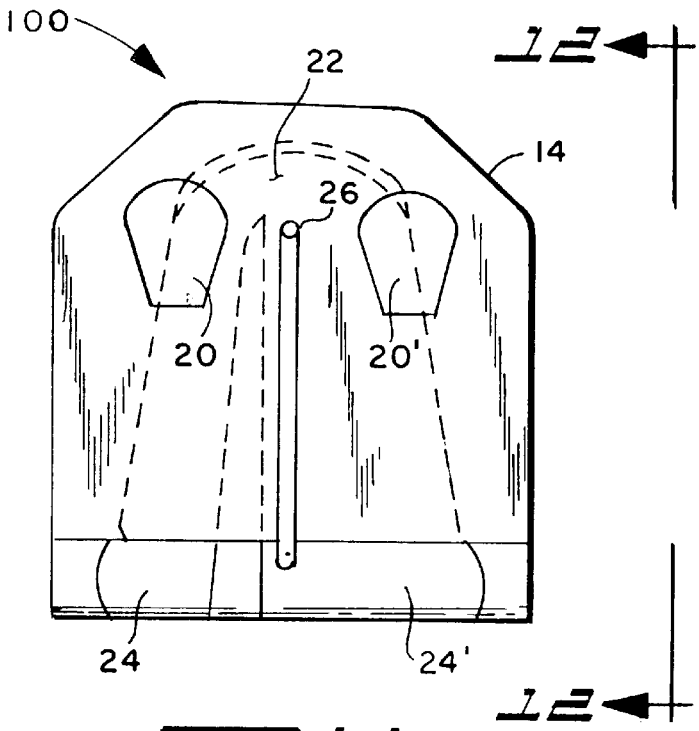
FIG. 11 is a back elevation view of an embodiment of the convertible ear ornament of the invention referenced by numeral 100.
Figure 12:
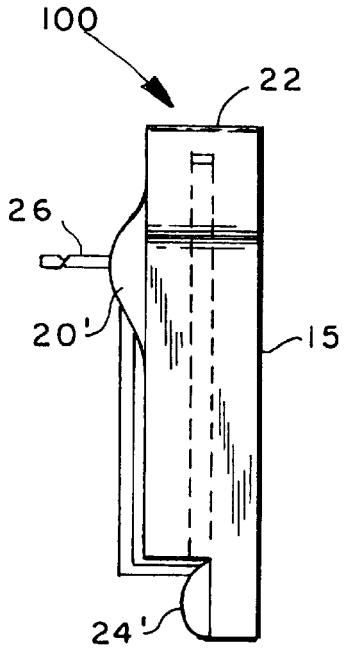
FIG. 12 is a side elevation view of ear ornament 100 taken along view line 12—12 in FIG. 11.

Bracket member 22 has a pair of resilient legs 24 and 24' that are spaced-apart from each other and adapted, upon being compressed or squeezed towards each other, to enable bracket member 22 to be inserted into pocket 16 and thence, upon release, to resiliently expand away from each other to engage the opposite side of pocket 16 (not referenced) to retain member 22 within pocket 16 with a portion of each leg remaining exposed outside of pocket 16 as shown in FIGS. 11 and 12 so that they can be later squeezed or compressed together to remove bracket member 22 from pocket 16.

The portion adjacent the free-end of legs 20 and 20' is preferably rounded or referenced by numerals 31 and 35 to facilitate their being squeezed towards each other and either one or both of legs 20 and 20' preferably include a notch such as referenced by numeral 29 that is adapted to engage one or both of the entrance corners at the side of the entrance into internal pocket 16 to enhance releasable securement between bracket member 22 and ornamental member 14.

Bracket member 22 includes an attachment member in the front of post member 26 that is either integral with or is secured to member 22 preferably at a location on the opposed portion of one of the legs such as leg 24' or referenced by numeral 30 in FIG. 3.

Post 26 is adapted to extend through a pierced opening through an ear portion and includes a notch or the like adjacent its free end referenced by numeral 28 to which a snap-ring or the like may be secured to retain post 26 within the pierced opening.

Post 26 is configured as shown in FIG. 4 in a sort of reverse "S" so that it can extend upwardly along the side of member 14 facing toward the ear after bracket 22 has been inserted into pocket 16.

Figure 7:
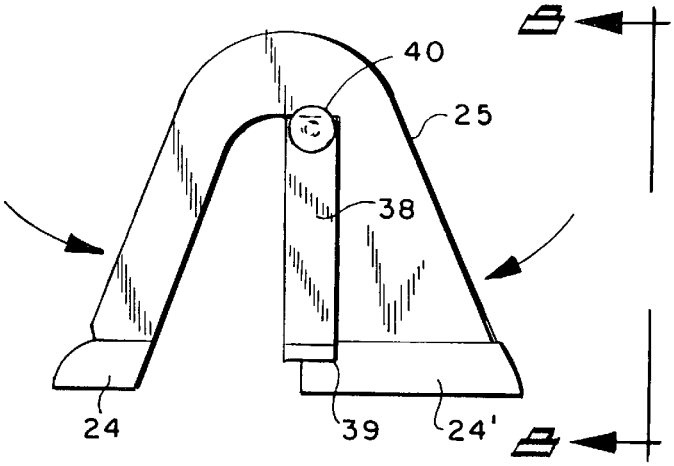
FIG. 7 is a front elevation view of another bracket member referenced by numeral 25.
Figure 8:
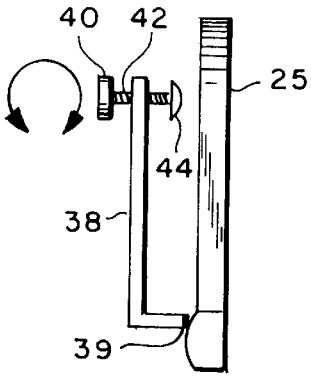
FIG. 8 is a side elevation view of bracket member 25 taken along view line 8—8 in FIG. 7.

Although not shown in the drawings, the ornamental member may include a slot through the side thereof facing towards the ear portion so that the connecting point between post 26 and bracket member 22 or member 38 supports threaded member 42 in FIGS. 7 and 8 can be moved upwardly towards the apex of the bracket member to simplify connection where suitable.

Like ornamental member 14, bracket member 22 and post member 26 are preferably made from gold such as 14 karat gold of hypoallergenic stainless steel and are preferably made as a one-piece die struck casting.

Figure 5:
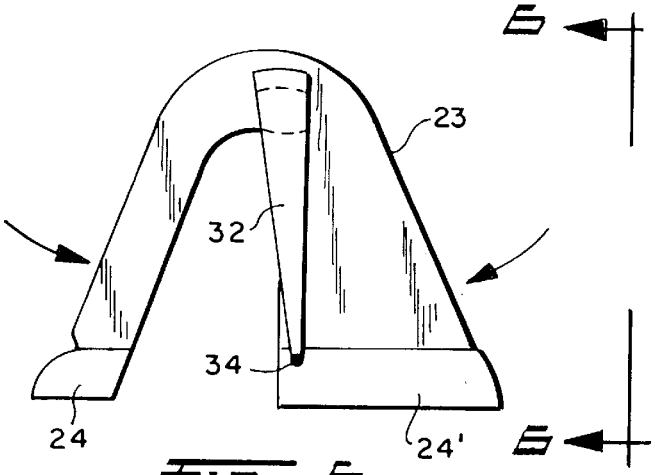
FIG. 5 is a front elevation view of another embodiment of the bracket member referenced by numeral 23.
Figure 6:
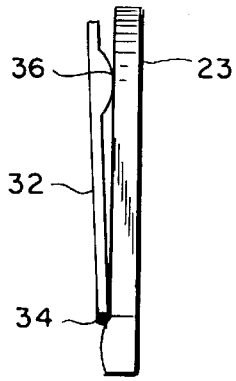
FIG. 6 is a side elevation view of bracket member 23 taken along view line 6—6 in FIG. 5.

Bracket member 23 of FIGS. 5 and 6 are substantially the same as bracket member 22 of FIGS. 3 and 4 excepting that post member 26 for attaching bracket member 22 to an ear portion has been replaced with a pivotable arm 30 that is pivotally secured to bracket member 23 as referenced by numeral 34.

Pivot arm 32 is operative to pivot in opposite directions as shown by the arrow in FIG. 6 so it can be pivoted outwardly away from bracket 23 to provide a space therebetween for an ear portion and thence resiliently close and clip member 23 to the ear portion.

Pivot arm 32 preferably includes an arcuate surface 36 adjacent to its free end that curves convexly outwardly to provide a rounded pad for engaging the ear portion.

In FIGS. 7 and 8 the means for attaching bracket member 25 to an ear portion is in the form of a threaded member 42 that is supported for rotation by member 38 and is integral with or secured to bracket member 25 at the location referenced by numeral 39.

Threaded member 42 includes a handle 40 to facilitate rotating it in opposite directions as shown by the arrow in FIG. 8. Rotation in one direction enlarges a space between member 42 and bracket member 25 for receipt of an ear portion such as an ear lobe therebetween and rotation in an opposite direction closes the space to clamp bracket member 25 to the ear portion.

Member 42 preferably includes an arcuate surface such as surface 44 that is curved convexly outwardly to provide a part for engaging the ear portion.

Figure 9:
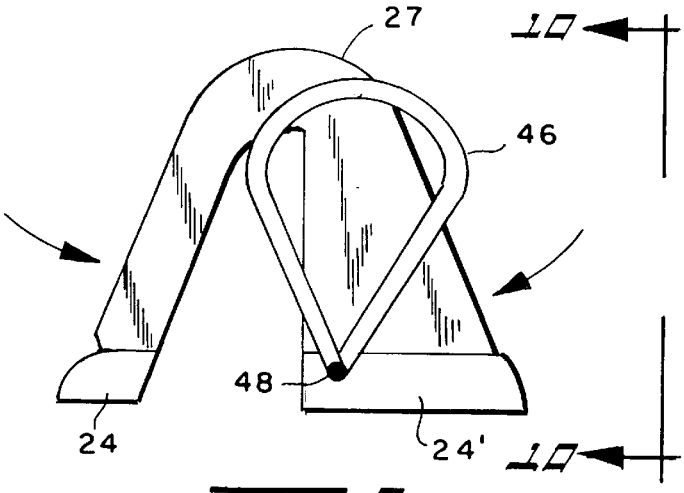
FIG. 9 is a front elevation view of yet another bracket member referenced by numeral 27.
Figure 10:
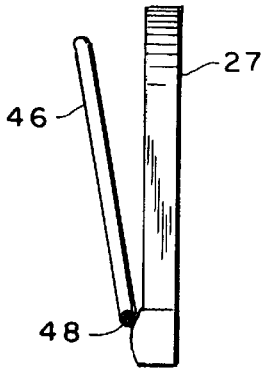
FIG. 10 is a side elevation view of bracket member 27 taken along view line 10—10 in FIG. 9.

In FIGS. 9 and 10, the means for attaching the bracket member of the convertible ear ornament of the invention to an ear portion is a closed loop member 46 that is secured at one end to bracket member 27 at the location referenced by numeral 39 and is adapted to extend about the ear so that bracket member 27 can hang therefrom while being releasably secured to ornamental member 14.

Loop member 46 may be continuous or a plurality of joined segments. Loop member 46 may, for example, be made from gold or hypoallergenic stainless steel strands on a stranded configuration that is non-irritating to the ear.

As earlier described, FIGS. 11 and 12 show the convertible ear ornament of the invention referenced by numeral 100 in which bracket member 22 has been releasably secured within pocket member 16 of ornamental 14 with a portion of the free ends of legs 24 and 24' remaining exposed to enable their being squeezed towards each other by hand for subsequent removal from ornamental member 14.

As shown in FIGS. 11 and 12, post 26 is configured so that it extends outwardly away from bracket member 22 at a location generally intermediate to arcuate surfaces 20 and 20' to ensure that they act as pads when engaging the ear portions.

Figure 13:
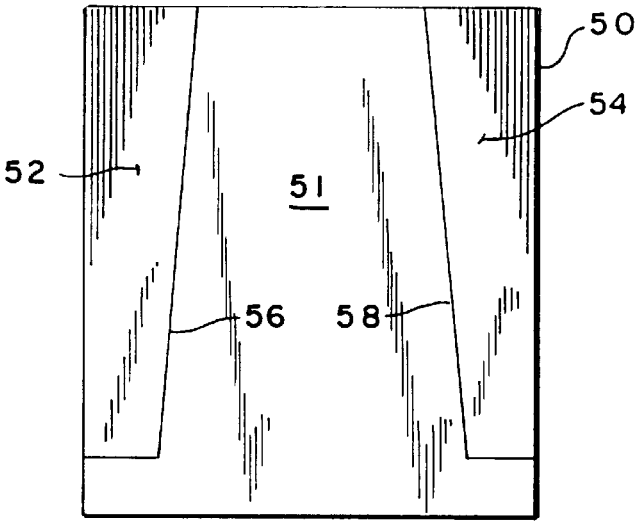
FIG. 13 is a back elevation view of another embodiment of an ornamental member of the invention referenced by numeral 50.
Figure 14:
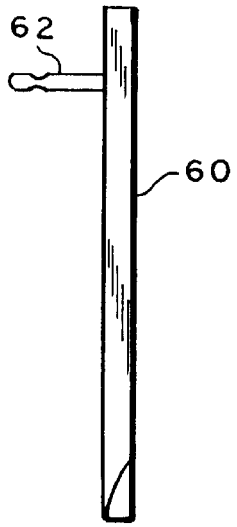
FIG. 14 is a side elevation view of a bracket member 60 operative for use with ornamental member 50 of FIG. 12.

Another embodiment of the ornamental portion of the convertible ear ornament of the invention is referenced by numeral 50 in FIG. 13 and an accompanying bracket member 60 is shown in FIG. 14.

Rather than having a close-sided pocket with an entrance for access at the bottom, ornamental member 50 has an open-sided pocket comprised of a pair of spaced-apart overhanging members 52 and 54 that preferably taper inwardly towards each other in a direction towards the top when viewed in FIG. 13. Overhanging members define facing elongate slots 56 and 58 in the space between themselves and the back of ornamental member 50 referenced by numeral 51.

Bracket member 60 includes a post 62 such as earlier described with respect to bracket member 22 of FIG. 4 with the advantage that post 62 is able to extend outwards directly from the top of bracket member 60 rather than to have to extend outwardly from the bottom of the bracket member and thence upwardly and again outwardly as shown in FIG. 4 in order to be on the outside of the close-sided pocket into which bracket member 22 is able to be expandably secured.

The convertible ear ornament of the invention provides a simple construction enabling one to easily replace one type of attachment member for another in selecting between the desire or need for having a pierced ear post, or a pivotal clip-on, or a rotating clamp, or a loop type of attachment for a decorative ear ornament.

What is claimed is:

1. A convertible ear ornament, said ornament comprising an ornamental member having an accessible open-sided pocket having an entryway thereinto, a bracket member having a pair of resilient spaced-apart legs operative to be received through the entryway into the pocket upon being squeezed towards each other and to thence expand away from each other upon their release to releasably secure the bracket member to the ornamental member with an end portion thereof exposed outside of the pocket, and attachment means secured to the bracket member and extending through the open side of the pocket for attaching the bracket member to an ear portion.

2. The ornament of claim 1 wherein the attachment means comprises a resilient arm that extends through the open side of the pocket and is pivotally secured at one end to the bracket member and operative, upon pivotal movement away therefrom, to receive the ear portion therebetween and thence, upon release, to pivot towards the bracket member and resiliently clip the bracket member to the ear portion.

3. The ornament of claim 1 wherein the attachment means comprises a resilient arm that extends through the open side of the pocket and is pivotally secured at one end to the bracket member and operative, upon pivotal movement away therefrom, to receive the ear portion therebetween and thence, upon release, to pivot towards the bracket member and resiliently clip the bracket member to the ear portion.

4. The ornament of claim 1 wherein the attachment means comprises a threaded member mounted for rotation on the bracket member and extending through the open end of the pocket to a free-end in facing relationship thereto, said threaded member operative upon rotation in one direction to move the free-end away from the bracket member for receipt of ear portion therebetween and upon rotation in the opposite direction to advance towards the bracket member and secure the ear portion thereto.

5. The ornament of claim 1 the attachment means comprises a looped member extending through the open end of the pocket and operative to encircle the ear.

6. The ornament of claim 1 wherein the ornamental member includes at least one arcuate surface adapted for engagement with the ear portion.

* * * * *